US005868839A

United States Patent [19]

Kato et al.

[11] Patent Number: 5,868,839

[45] Date of Patent: Feb. 9, 1999

[54] LIQUID METERING AND COATING ASSEMBLY

[75] Inventors: Hiroshi Kato; Hiroyasu Kikukawa, both of Okayama-ken, Japan

[73] Assignee: Japan Gore-Tex, Inc., Tokyo, Japan

[21] Appl. No.: 506,603

[22] Filed: Jul. 25, 1995

[30] Foreign Application Priority Data

Aug. 5, 1994 [JP] Japan ..... 6-204317

[51] Int. Cl.[6] ..... B05C 11/00

[52] U.S. Cl. ..... 118/264; 118/DIG. 15; 184/17; 184/23; 184/101; 15/103.5; 492/56

[58] Field of Search ..... 118/264, DIG. 15; 184/17, 23, 101; 101/348; 355/269, 270, 277, 283, 290, 299; 15/103.5; 492/48, 49, 51, 53, 56, 59

[56] References Cited

U.S. PATENT DOCUMENTS

| | | | |
|---|---|---|---|
| 4,165,173 | 8/1979 | Iwai et al. | 355/299 |
| 4,198,739 | 4/1980 | Budinger et al. | 101/348 |
| 4,359,963 | 11/1982 | Saito et al. . | |
| 4,533,231 | 8/1985 | Shigenobu . | |
| 4,563,073 | 1/1986 | Reynolds | 355/3 FU |
| 4,949,130 | 8/1990 | Torino | 355/282 |
| 5,123,151 | 6/1992 | Uehara et al. . | |
| 5,136,968 | 8/1992 | Sarada et al. | 101/348 |
| 5,142,122 | 8/1992 | Ariyama . | |
| 5,232,499 | 8/1993 | Kato et al. | 118/244 |
| 5,400,128 | 3/1995 | Michlin . | |
| 5,482,552 | 1/1996 | Kikukawa et al. | 118/DIG. 15 |
| 5,517,709 | 5/1996 | Caffrey et al. | 15/103.5 |
| 5,532,056 | 7/1996 | Satoh et al. | 355/277 |
| 5,657,504 | 8/1997 | Khoury | 15/103.5 |

FOREIGN PATENT DOCUMENTS

| | | |
|---|---|---|
| 0 479 564 A3 | 4/1992 | European Pat. Off. . |
| 0 616 271 | 9/1994 | European Pat. Off. . |
| 8-262945 | 10/1996 | Japan . |
| 1 561 815 | 3/1980 | United Kingdom . |

OTHER PUBLICATIONS

International Search Report.

*Primary Examiner*—Peter Chin
*Assistant Examiner*—Michael P. Colaianni
*Attorney, Agent, or Firm*—Gary A. Samuels; Carol A. Lewis White

[57] ABSTRACT

A liquid metering and coating assembly for use in a thermal toner fixation unit of a plain paper copier or printer. The assembly consists of a release oil-supply roll having a compliant and flexible porous permeation control layer and a cleaning blade. The cleaning blade is mounted so as to contact the surface of the permeation control material. The cleaning blade removes excess toner and other incidental debris from the surface of the permeation control layer thereby providing a freshly cleaned surface from which controlled amounts of release oil are uniformly coated onto the surface of an adjacent contacting roll.

10 Claims, 1 Drawing Sheet

Comparative Example

LIQUID METERING AND COATING ASSEMBLY

FIELD OF THE INVENTION

The present invention relates to an assembly for coating controlled amounts of liquids on to rolls or other surfaces, more particularly to an assembly for coating release liquids on to the surfaces of heating and fixation rolls in thermal toner fixation units of plain paper copying and printing machines.

BACKGROUND OF THE INVENTION

In a plain-paper copier (PPC) or printer, toner images applied to the surface of paper or other recording medium are fixated by application of heat and pressure. In certain PPC machines fixation is accomplished by passing the image-bearing recording medium between a hot thermal-fixation roll and a pressure roll. When this type of thermal-fixation device is used the toner material is directly contacted by a roll surface and a portion of the toner adheres to the roll surface. With subsequent rotation of the roll the adhered toner material may be redeposited on the recording medium resulting in undesirable offset images, stains, or smears; or, in severe cases, the recording medium may stick to the adhered toner material on the roll and become wrapped around the roll.

To counter these problems materials having good release properties such as silicone rubber or polytetrafluoroethylene are often used for the roll surfaces. Although improving performance of the thermal fixation devices, use of silicone rubber or polytetrafluoroethylene roll surfaces alone do not eliminate the problems. Another approach used to counter the problems is to include release agents with the toner materials to prevent them from adhering to the roll surface. These oilless toners also improve performance of the thermal-fixation devices but again, particularly in the case of high-speed type copying machines, do not completely eliminate the problems associated with toner pickup and transfer.

Toner pickup by the rolls can be controlled by coating the surface of at least one of the rolls of a thermal fixation device with a liquid release agent, such as a silicone oil. It is important that the release liquid be applied uniformly and in precise quantities to the surface of the roll. It is also important that such be done in a manner to permit extended usage of the machine in order to minimize service costs and keep the cost per copy or printed page at a competitive level.

Means to supply release liquids to the heating and pressure rolls of a thermal fixation unit are known in the art and include wicks, pressure pads, and rolls. Such means usually include at least a thick porous material, such as felts of Nomex® fibers, glass fibers, carbon fibers, or polytetrafluoroethylene fibers, which may be covered with a porous permeation control material, such as porous polytetrafluoroethylene tubing or film. The thick porous material serves as a wick or reservoir for supplying the release liquid, usually a silicone oil, to the surface of a heating-, pressure-, or oil- transfer-roll. Also known in the art as means to supply controlled amounts of release liquids are oil-supply rolls having porous support cores of synthetic polymers, or elastomeric polymers, on the surface of which are porous permeation control layers formed of polytetrafluoroethylene film, or polytetrafluoroethylene film which has been impregnated with a mixture of silicone oil and silicone rubber followed by a heat treatment to crosslink the silicone rubber. Such rolls having highly compliant flexible surfaces are described in U.S. Pat. Nos. 5,123,151 (to Uehara, et al.), 5,232,499 (to Kato, et al.), and European Patent Application Publication No. 0 616 271 A2 (to Kikukawa, et al.).

Initially, thermal fixation units which incorporate such liquid supply devices perform satisfactorily and produce excellent high quality images. However, over a period of time, toner particles and agglomerates, paper particles, and other types of incidental dust and debris deposit on the heating and pressure rolls. The deposited debris can adversely affect the operation of a thermal fixation unit in a number of ways. Particles can damage the surface of the rolls by scratching, denting, or becoming embedded, and thus adversely influence image quality and fixation. Ultimately, they may also be transferred from the heating rolls, pressure rolls, or oil-transfer rolls to the surfaces of the release liquid supply devices, where they adversely influence uniformity and quantity of the oil supply, and where they may further damage the surface of contacting rolls.

To prevent, or at least minimize, damage from such particulate debris, cleaning mechanisms such as scraper blades, wiper blades, or separate cleaning rolls and brushes have been used. For the most part, these mechanisms have been applied so that the scraper blades, wiper blades, etc. are in direct contact with the surfaces of the heating rolls, pressure rolls, or oil-transfer rolls from which they are to remove excess toner, paper particles, and other debris. Damage to the roll surfaces by the scrapers and wipers can occur, as well as damage by particles trapped between the blades and the surfaces. Although such mechanisms significantly improve the length of service-free operation of thermal fixation units, none have prevented the eventual accumulation of particulate debris on the surfaces from which release oil is initially supplied and, consequently, the adverse effect on the uniformity and amount of oil supply which ensues from such accumulation.

SUMMARY OF THE INVENTION

The invention is a liquid metering and coating assembly which provides long service-free use of a thermal toner fixation unit in a plain paper copier or printer. The assembly prevents accumulation of excess toner, paper particles, or other particulate debris on the surface of an oil-supply roll, and prevents redistribution of the particulate debris to another roll which is in contact with the oil-supply roll, by means to remove the particulate debris from the compliant flexible surface of the oil-supply roll.

The liquid metering and coating assembly comprises an oil-supply roll and a means to remove excess toner and other particulate debris from the surface of the oil-supply roll. The oil-supply roll comprises a compliant and flexible permeation control layer adhered to the surface of a porous open-celled support material comprising an elastomeric material. The support material contains in its pores a liquid release agent consisting of a mixture of silicone oil and cross-linked silicone rubber.

In a preferred embodiment of the invention, the means to remove excess toner is a cleaning blade in contact with the permeation control layer of the oil-supply roll.

DETAILED DESCRIPTION OF THE INVENTION

Figure 1:
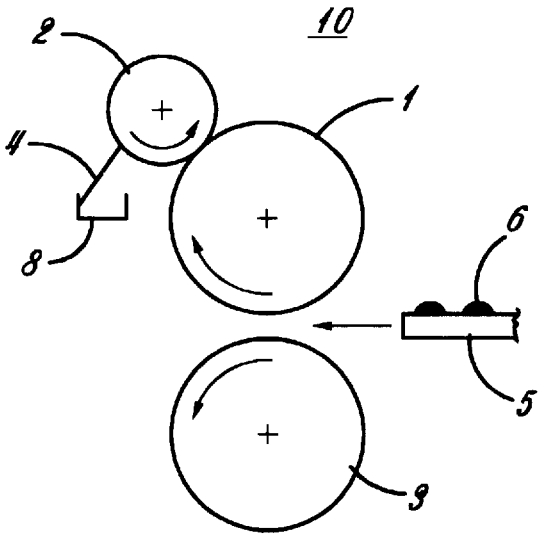
FIG. 1 is a schematic diagram of the assembly of the invention positioned in a thermal toner fixation unit.

In FIG. 1 a preferred embodiment of the liquid metering and coating assembly of the invention is shown schematically as part of a thermal toner fixation unit of a plain paper copying machine. The liquid metering and coating assembly of the thermal fixation unit 10 consists of an oil-supply roll 2 and cleaning blade 4 in contact with the oil-supply roll. In operation the oil-supply roll contacts and coats the surface of heating roll 1 with a release agent, usually a silicone oil. A recording medium, such as paper 5 carrying an unstabilized (unfixated) toner image 6, is passed through the nip formed between heating roll 1 and pressure roll 3 by rotation of the rolls. As paper 5 passes through the nip the toner image 6 is fixated on the paper by application of heat and pressure. As the surface of the heating roll 1 contacted by paper 5 and toner 6 passes by the contacting surface of oil-supply roll 2, excess toner and incidental debris, such as paper particles, may be transferred from the heating roll 1 to the oil-supply roll 2. Cleaning blade 4, in contact with the surface of oil-supply roll 2, removes the toner and incidental debris from the surface of the oil-supply roll to a receiver 8, thus enabling oil-supply roll 2 to uniformly apply a controlled amount of release oil from its freshly cleaned surface to the surface of heating roll 1.

The cleaning blade 4 can be a conventional type, preferably shaped as a plate in the range of 10 to 2000 micrometers thick, preferably in the range 50 to 1000 micrometers thick. It should be made of materials having sufficient strength and heat resistance for long-term service at operating temperatures encountered in thermal fixation units of photocopiers and printers, typically in the range 150° C. to 250° C. Suitable materials include, but are not limited to, polyimides, metals, and fluorine-containing elastomers. The cleaning blade 4 is mounted by any convenient method so as to have an edge in intimate contact with the surface of the oil-supply roll 2 over the length of the region to be cleaned.

Although a cleaning blade can work effectively on a variety of surfaces, to ensure intimate contact and efficient particulate removal, it is preferred for the assembly of the invention that the surface of the oil-supply roll 2 be formed of a compliant and flexible porous permeation control layer adhered to a porous open-celled support material comprising an elastomeric material (which enhances compliance and flexibility of the surface layer). Such compliance and flexibility also tends to reduce damage to both the cleaning blade 4 and the porous permeation control layer of the oil-supply roll 2. Suitable oil-supply rolls are described hereinbelow and are fully disclosed in U.S. Pat. Nos. 5,123,151 (to Uehara, et al.), 5,232,499 (to Kato, et al.), and European Patent Application Publication No. 0 616 271 A2 (to Kikukawa, et al.).

It is preferred that the surface layer (porous permeation control layer) of the oil-supply roll 2 comprises a porous polytetrafluoroethylene membrane. Porous polytetrafluoroethylene membranes suitable for use in the invention can be made by processes known in the art, for example, by papermaking processes, by powder processes using granular PTFE resin, or by processes in which filler materials are incorporated with the PTFE resin and then are subsequently removed to leave a porous structure. Preferably the porous polytetrafluoroethylene membrane is porous expanded polytetrafluoroethylene membrane having a structure of interconnected nodes and fibrils as described in U.S. Pat. Nos. 3,953,566 and 4,187,390, which fully describe the preferred material and processes for making them. The porous polytetrafluoroethylene membrane of the permeation control material should have a thickness in the range 1 to 1,000 micrometers, preferably in the range 5 to 100 micrometers; a pore volume in the range 20 to 98 percent, preferably in the range 50 to 90 percent; and a nominal pore size in the range 0.05 to 15 micrometers, preferably in the range 0.1 to 2 micrometers. The porous polytetrafluoroethylene membrane provides abrasion resistance, thermal and chemical stability, and excellent release characteristics. The porous polytetrafluoroethylene membrane also has excellent strength, compliance and flexibility properties.

The porous polytetrafluoroethylene membrane can be adhered to the porous open-celled support material by an adhesive. The adhesive is preferably a thermoplastic or thermosetting synthetic polymer material, although other types of adhesives may be used so long as they have the heat resistance, durability, and chemical compatibility for an intended end use. Many such materials are known in the art. The adhesive can be applied to form a porous layer by conventional means, for example, by spraying, coating or gravure printing methods; or by use of a porous mesh or nonwoven web, and the like, interposed between the materials to be joined.

Also suitable as the porous permeation control layer is porous expanded polytetrafluoroethylene film which is impregnated with silicone rubber or a mixture of silicone oil and silicone rubber, after which the silicone rubber is cross-linked and cured, as described in U.S. Pat. No. 5,232,499 (to Kato, et al.) and European Patent Application Publication No. 0 616 271 A2 (to Kikukawa, et al.). Impregnation is done in such a way that sufficient interconnected porosity in the permeation control layer is preserved so as to control the permeability rate of release agent through the layer. For these purposes a variety of types of silicone rubber can be used. For example, RTV (room temperature vulcanizing) silicone rubber, LTV (low temperature vulcanizing) silicone rubber, HTV (high temperature vulcanizing) silicone rubber, ultraviolet radiation curable silicone rubber, and the like can be used. The silicone oil is preferably a dimethyl silicone oil.

The porous permeation control material is adhered to a non-rigid porous open-celled support material which functions in a dual role; it provides support to the permeation control layer, and serves as a reservoir from which release agent, preferably a dimethyl silicone oil, is supplied to the permeation control layer. The silicone oil is preferably introduced and stored in the porous support material as a mixture of silicone oil and silicone rubber, after which the silicone rubber is cross-linked to form a gel. The porous support material can be an open-celled foam of silicone rubber of the types listed above. It can also be made using a non-rigid open-celled synthetic polymer foam. Suitable non-rigid porous materials are commercially available and, in addition to silicone rubber as described above, can be of synthetic polymers such as, for example, polyester polyurethane, polyether polyurethane, polyvinyl chloride, polyethylene, polystyrene, and the like. By non-rigid is meant that the material is not a hard, stiff, brittle material.

The porous open-celled foam used in the porous support material should be an open-celled foam or other continuous pore structure having a pore volume of at least 40 wt. %, preferably in the range 60 wt. % to 99.9 wt. %. Porous support materials having pore volumes less than 40 percent have inadequate liquid holding capacity and may have structures that restrict liquid movement through them. Materials with pore volumes greater than 99.9 percent have such an open, weak structure that, even when reinforced, durability is too difficult to obtain. The porous support material should be at least 1 millimeter thick, preferably 3 millimeters or more. The porous support material should have a surface hardness of 70 degrees or less, preferably 50 degrees or less, as measured by Japan Rubber Association Standard SRIS-0101. Furthermore, the porous support material must be chemically compatible with and wettable by the liquids of use, and must have sufficient strength and heat resistance for operation in the temperature range 150° C. to 250° C.

To obtain a large reservoir capacity, a porous support material may be made using an open-celled foam having a very high pore volume and a relatively weak structure. In such a case, a porous reinforcing region comprising cross-linked silicone rubber can be formed internally within the porous support material contiguous to the permeation control material. The reinforcing region provides effective reinforcement to the device through its affinity and bonding with the cross-linked silicone rubber comprised in the permeation control material, to the porous support material, and with the crosslinked silicone rubber of the oil-supply reservoir contained in the porous support material. The reinforcing material adds strength and elasticity to the device, and improves compliance of the oil permeation control material to the surface to be coated, as well as to the cleaning blade.

The reinforcing region should have a thickness of 5% to 50%, preferably 10% to 20%, of the thickness of the porous support material. When the thickness of the reinforcing region is less than 5% of the thickness of the support material, it is too thin to provide effective reinforcement. When the thickness of the reinforcing region is greater than 50% of the thickness of the support material, the resistance to permeation of oil supplied from the oil supply reservoir is excessive. As described in U.S. Pat. No. 5,232,499 (to Kato, et al.) and European Patent Application Publication No. 0 616 271 A2 (to Kikukawa, et al.), the reinforcing region can be formed of silicone rubber, or from a mixture of silicone oil and silicone rubber, in a manner such that porosity, i.e., a continuous network of interconnected pores, is maintained and oil supplied from the oil-supply reservoir can pass through the reinforcing region to enter the permeation control material.

An oil supply reservoir can be formed internally within the porous support material by introducing a mixture of silicone oil and silicone rubber into the end of the porous support material and spinning the support about its axis, thus using centrifugal force to direct the mixture outwardly within the support material to a region contiguous with the permeation control material and leaving a region of the porous support unfilled by the mixture, as taught in U.S. Pat. No. 5,232,499. Gelation of the mixture forming the oil supply is then effected by crosslinking the silicone rubber. The concentration of silicone oil in the oil supply mixture should be in the range 10 percent to 98 percent by weight, preferably in the range 50 percent to 95 percent by weight. When the concentration of silicone oil in the mixture is less than about 10 wt. % the mobility of the liquid is limited and transfer of the oil through the porous support material and into the permeation control material is excessively slow. When the concentration of silicone oil in the mixture exceeds 98 wt. % there is too little gel formed by the cross-linking silicone rubber and the oil will leak from the porous support material. The amount of silicone oil and silicone rubber mixture impregnated into the porous support material to form the oil supply reservoir should be such that 30 percent to 90 percent, preferably 50 percent to 80 percent, of the pore volume of the porous support material is filled. When more than 90% of the pore volume of the support material is filled there is insufficient remaining volume to accommodate expansion of the mixture if it is heated to effect cross-linking, and leakage may occur. When less than 30% of the pore volume of the support material is filled there is insufficient oil present to provide an adequate operating life span to the device.

The silicone oil and silicone rubber forming the mixtures described above are preferably of the types listed earlier. Certain relationships in their relative concentrations, depending on their use in the porous support material, should be observed. When the oil permeation control layer consists of a porous polytetrafluoroethylene membrane impregnated with a mixture of silicone oil and silicone rubber and the support material consists of open-celled silicone rubber foam, the silicone oil content of the mixture in the permeation control material must be less than the silicone oil content of the silicone oil and silicone rubber oil-supply mixture contained in the porous support material. Likewise, when the reinforcing material is silicone rubber only, the silicone oil content of the mixture in the permeation control material must be less than the silicone oil content of the silicone oil and silicone rubber oil-supply mixture contained in the porous support material. When the reinforcing material region is formed by a mixture of silicone oil and silicone rubber, the silicone oil content of the permeation control material must be less than the silicone oil content of the reinforcing material region, and the silicone oil content of the reinforcing region must be less than the silicone oil content of the oil supply mixture.

In the embodiments of the invention described hereinabove in which silicone rubber and/or mixtures of silicone oil and silicone rubber are used, it has been found that a portion of the cross-linked silicone rubber network of any region is strongly bonded to a portion of the cross-linked silicone rubber network in the adjoining region, or to the open-celled silicone rubber foam of the porous support material, so that an interconnected network of silicone rubber is continuous throughout the device. The reason for this strong bonding is not definitely known as it would seem that, after cross-linking, there should be no functional groups left in the silicone rubber for chemical bonding to another previously cross-linked silicone rubber. It may be due to an affinity between cross-linked silicone rubbers in close proximity. However, it is apparent from comparison of examples of the invention with the comparative example described hereinbelow, that the bonding between the cross-linked silicone rubbers used in the invention is strong.

It has been further determined that the strong bonding mechanism promotes use of a porous reinforcing region comprising silicone rubber that strengthens the porous support material of silicone rubber foam, as well as support material of other synthetic polymers, so that porous support materials having very high pore volumes, for example, greater than 90%, and thus higher liquid holding capacity, can be used.

EXAMPLE 1

A liquid metering and coating assembly was prepared as follows:

An 8 mm diameter steel shaft was inserted axially into a porous tube formed of an open-celled polyester polyurethane foam. The polyester polyurethane foam support material had an outer diameter of 27 mm, an inner diameter of 8 mm, surface hardness of less than 1 degree, bulk density of 30 kg/cubic meter, and a pore volume of 98%.

A reinforcing region in the porous support material was prepared as follows:

A predetermined amount of addition reaction hardening silicone rubber (KE1300, manufactured by Shin-Etsu Chemical Co., Ltd.) was poured on a plate glass surface. The polyester polyurethane foam support material was rolled in the liquid silicone rubber until it was impregnated into the porous support material. The impregnated support material was then repeatedly rolled on a corrugated brush-like surface causing it to flex, thus distributing the liquid silicone rubber in the pores of the support material so as to coat the internal surfaces of the porous support material and thereby maintaining internal porosity of interconnected pores through the reinforcing region. The reinforced porous support material had a surface hardness of 12 degrees, bulk density of 100 kg/cubic meter, and a pore volume of 90%.

A porous expanded polytetrafluoroethylene membrane having a thickness of about 30 micrometers, a nominal pore size of 0.4 micrometers, and a pore volume of about 80%, was gravure printed on one side with a non-continuous pattern of 0.5 mm diameter dots of thermoplastic adhesive to form a porous layer of adhesive on the membrane. A permeation control material was formed by first wrapping a single layer of the adhesive printed membrane around the porous support material and thermally fusing it in place by application of heat and pressure.

A mixture of 20 wt. % silicone oil (KF-96, manufactured by Shin-Etsu Chemical Co., Ltd. and used as a releasing agent) and 80 wt. % silicone rubber (KE-106, manufactured by Shin-Etsu Chemical Co., Ltd.) was prepared. The porous expanded polytetrafluoroethylene membrane was impregnated with the silicone oil and silicone rubber mixture after which the excess mixture was removed from the film surface and the assembly heated at 150° C. for 40 minutes to crosslink the silicone rubber, thus completing formation of the permeation control material.

A second mixture of the silicone oil and silicone rubber described above, having a silicone oil content of 90 wt. % and silicone rubber content of 10 wt. %, was poured into the end of the porous support material and, by spinning the assembly about its axis, was directed outwardly through the porous support body to form an oil-supply reservoir contiguous with the permeation control material and leaving a section of the porous support body unfilled by the mixture. The assembly was then heated at 150° C. for 80 minutes to crosslink the silicone rubber and cause gelation in the oil-supply layer, and the oil-supply roll was completed.

In the positional relationship shown in FIG. 1, the oil-supply roll 2 was mounted in a test unit (VIVACE 800 copier, manufactured by Fuji-Xerox Co.) in contact with a heating roll 1. A polyimide cleaning blade 4, 100 micrometers thick, 15 millimeters wide, and 300 millimeters long, was mounted in contact with the surface of the oil-supply roll 2, thus completing the assembly.

The liquid metering and coating assembly was tested using A4 size Type R paper (manufactured by Fuji-Xerox Co.). The test unit was operated in the continuous copy mode in cycles of 100 copies followed by a 5 second stop. The oil-supply roll was removed and weighed at the intervals shown in Table 1. The oil feed rate was calculated as follows:

Oil Feed Rate=(Interval initial wt.–interval final wt.) / Number of copies (The weight values, therefore, include the weight of any toner or debris accumulated on the roll.)

The oil feed rate was initially 0.009 mg/copy, and remained stable (0.008–0.009 mg/copy) throughout the test, which involved about 20,000 copies. This indicates an almost total absence of adhered toner or other incidental debris. In addition, the surface condition of the roll was examined at the conclusion of the test and no damage was observed. The results are tabulated in Table 1.

Comparative Example 1

Figure 2:
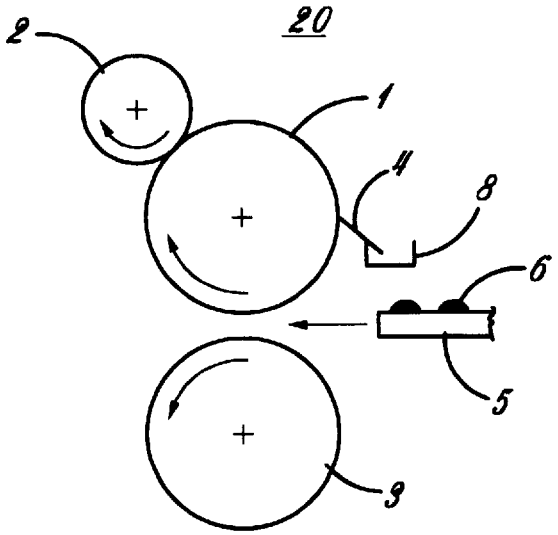
FIG. 2 is a schematic diagram of the thermal toner fixation test unit of Comparative Example 1.

An oil-supply roll was prepared and mounted in a test unit as described in Example 1 above. However, as shown in FIG. 2, in the test unit 20, the cleaning blade 4 was mounted in contact with the surface of heating roll 1.

The oil-supply roll was tested as described above and the results are tabulated in Table 1. The oil feed rate was initially 0.008 mg/copy, and remained at a level of 0.006–0.008 mg/copy throughout the test, which involved about 20,000 copies. This indicates that toner or other debris had adhered to the oil-supply roll in relatively small amounts. However, when the surface condition of the roll was examined at the conclusion of the test, it was found that microcracks had formed in the circumferential direction of the roll.

Comparative Example 2

An oil-supply roll was prepared and mounted in a test unit as described in Examples 1 and 2 above. However, for this test no cleaning blade was used.

The oil-supply roll was tested as described above and the results are tabulated in Table 1. The oil feed rate measured at the first interval was 0.000 mg/copy indicating virtually no weight change occurred. The weight changes varied between −0.002–0.001 mg/copy throughout the test, which involved about 20,000 copies. This indicates that toner and other incidental debris had adhered to the oil-supply roll. The surface of the roll was examined at the conclusion of the test and no damage was observed.

TABLE 1

| Example 1 | | Comp. Example 1 | | Comp. Example 2 | |
|---|---|---|---|---|---|
| Number of copies | Oil Feed Rate | Number of copies | Oil Feed Rate | Number of copies | Oil Feed Rate |
| 0 to 5037 | 0.009 | 0 to 5040 | 0.008 | 0 to 5095 | 0.000 |
| 5037 to 10067 | 0.008 | 5040 to 10042 | 0.007 | 5095 to 10311 | −0.002 |
| 10067 to 15103 | 0.009 | 10042 to 15069 | 0.006 | 10311 to 15527 | 0.000 |
| 15103 to 20138 | 0.008 | 15069 to 20008 | 0.007 | 15527 to 20210 | 0.001 |

We claim:

1. A liquid metering and coating assembly comprising (a) an oil-supply roll having a flexible compliant porous polytetrafluoroethylene surface structured to meter oil from inside the oil-supply roll through said porous surface to the surface of the oil-supply roll and coat said oil onto an adjacent surface, and (b) means contacting said oil-supply roll for removal of debris from the surface of said supply roll.

2. The liquid metering and coating assembly of claim 1 wherein said means comprises a scraper blade.

3. The liquid metering and coating assembly of claim 2 wherein said scraper blade is made of a polymeric material.

4. The liquid metering and coating assembly of claim 3 wherein said polymeric material is selected from the group consisting of polyimide and fluoropolymers.

5. The liquid metering and coating assembly of claim 3 wherein said scraper blade is made of an elastomeric polymer.

6. The liquid metering and coating assembly of claim 5 wherein said scraper blade is made of a fluorine-containing elastomeric polymer.

7. The liquid metering and coating assembly of claim 1 wherein said scraper blade is made of a metal.

8. The liquid metering and coating assembly of claim 1 wherein the pores of said porous polytetrafluoroethylene material contain a mixture of silicone oil and silicone rubber.

9. The liquid metering and coating assembly of claim 1 wherein said porous polytetrafluoroethylene material is a porous expanded polytetrafluoroethylene membrane.

10. The liquid metering and coating assembly of claim 8 wherein said porous polytetrafluoroethylene material is a porous expanded polytetrafluoroethylene membrane.

* * * * *